US010288068B2

(12) United States Patent
Ge

(10) Patent No.: US 10,288,068 B2
(45) Date of Patent: May 14, 2019

(54) SCREW COMPRESSOR HAVING OIL SEPARATOR AND WATER CHILLING UNIT

(71) Applicant: Carrier Corporation, Farmington, CT (US)

(72) Inventor: Shaofei Ge, Shanghai (CN)

(73) Assignee: CARRIER CORPORATION, Farmington, CT (US)

( * ) Notice: Subject to any disclaimer, the term of this patent is extended or adjusted under 35 U.S.C. 154(b) by 40 days.

(21) Appl. No.: 15/306,829

(22) PCT Filed: Apr. 28, 2015

(86) PCT No.: PCT/US2015/027959
§ 371 (c)(1),
(2) Date: Oct. 26, 2016

(87) PCT Pub. No.: WO2015/168101
PCT Pub. Date: Nov. 5, 2015

(65) Prior Publication Data

US 2017/0045053 A1 Feb. 16, 2017

(30) Foreign Application Priority Data

Apr. 29, 2014 (CN) ..... 2014 1 0176284

(51) Int. Cl.
*F03C 2/00* (2006.01)
*F03C 4/00* (2006.01)
(Continued)

(52) U.S. Cl.
CPC ..... *F04C 29/026* (2013.01); *F04C 18/16* (2013.01); *F04C 23/008* (2013.01);
(Continued)

(58) Field of Classification Search
CPC ..... F04C 23/008; F04C 29/026; F04C 18/16; F04C 2240/809; F04C 2240/40;
(Continued)

(56) References Cited

U.S. PATENT DOCUMENTS 5,328,344 A * 7/1994 Sato ..... F04C 29/04 418/85
6,506,039 B1 1/2003 Osumimoto et al.
(Continued)

FOREIGN PATENT DOCUMENTS

CN 202792748 U 3/2013
DE 10221396 A1 12/2003
(Continued)

OTHER PUBLICATIONS

International Search Report for application PCT/US2015/027959, dated Jun. 12, 2015, 11 pages.

*Primary Examiner* — Theresa Trieu
(74) *Attorney, Agent, or Firm* — Cantor Colburn LLP

(57) ABSTRACT

A screw compressor having an oil separator, includes a compressor housing with an inlet for a refrigerant gas flow to flow in; an oil separator housing connected to the compressor housing in a fastened and sealed manner and having an outlet for the refrigerant gas flow to flow out; a compressing assembly disposed within the compressor housing and close to the inlet for compressing the refrigerant gas flow; an electric motor for driving the compressing assembly; and an oil supply device for supplying a freezing oil to the compressing assembly; the screw compressor further comprises an oil separator, the oil separator is disposed within the oil separator housing and comprises a first separator and a second separator, wherein the second separator is
(Continued)

disposed close to the outlet, and the first separator is disposed between the compressing assembly and the second separator.

10 Claims, 1 Drawing Sheet

(51) Int. Cl.

| | |
|---|---|
| ***F04C 15/00*** | (2006.01) |
| ***F04C 2/00*** | (2006.01) |
| ***F04C 29/02*** | (2006.01) |
| ***F04C 23/00*** | (2006.01) |
| ***F04C 18/16*** | (2006.01) |
| ***F04C 29/00*** | (2006.01) |
| ***F04C 29/04*** | (2006.01) |
| ***F04C 29/12*** | (2006.01) |
| ***F25B 1/047*** | (2006.01) |
| ***F25B 31/00*** | (2006.01) |

(52) U.S. Cl.
CPC ..... *F04C 29/0085* (2013.01); *F04C 29/0092* (2013.01); *F04C 29/04* (2013.01); *F04C 29/12* (2013.01); *F25B 1/047* (2013.01); *F25B 31/002* (2013.01); *F04C 2240/30* (2013.01); *F04C 2240/40* (2013.01); *F04C 2240/809* (2013.01); *F25B 2400/23* (2013.01)

(58) Field of Classification Search
CPC ..... F04C 2240/30; F04C 29/04; F04C 29/12; F04C 29/0092; F04C 29/0085; F25B 1/047; F25B 2400/23; F25B 31/002
USPC ... 418/46–47, 83, 89, 97, 201.1–201.3, 270, 418/DIG. 1
See application file for complete search history.

(56) References Cited

U.S. PATENT DOCUMENTS

| | | | | |
|---|---|---|---|---|
| 6,554,595 | B2 | 4/2003 | Hida et al. | |
| 6,769,880 | B1 | 8/2004 | Hogan | |
| 7,014,437 | B2 | 3/2006 | Ohsumimoto et al. | |
| 7,033,144 | B2 * | 4/2006 | Yoshimura ..... | F04B 39/02 417/228 |
| 8,080,080 | B2 | 12/2011 | Becker et al. | |
| 8,491,280 | B2 | 7/2013 | Kameya et al. | |
| 2012/0099966 | A1 | 4/2012 | Ma | |
| 2012/0301343 | A1 | 11/2012 | Satou et al. | |

FOREIGN PATENT DOCUMENTS

| | | | |
|---|---|---|---|
| EP | 1431580 | A1 | 6/2004 |
| EP | 1705437 | A1 | 9/2006 |
| JP | H0326879 | A | 2/1991 |
| JP | H051685 | A | 1/1993 |
| JP | 2002242865 | A | 8/2002 |
| JP | 2003083272 | A | 3/2003 |
| JP | 2008291655 | A | 12/2008 |
| JP | 2013227890 | | 11/2013 |
| KR | 100710379 | B1 | 4/2007 |

* cited by examiner

SCREW COMPRESSOR HAVING OIL SEPARATOR AND WATER CHILLING UNIT

FIELD OF THE INVENTION

The present invention relates to a screw compressor having an oil separator, and further to a water chilling unit equipped with the screw compressor.

DESCRIPTION OF THE RELATED ART

The Chinese Patent Application CN202792748 disclosed by Ling Dong provides a sleeve cyclone-type oil separator. The sleeve-type cyclone oil separator disclosed by said patent for a screw compression heat pump comprises an oil storage cylinder and a perforated plate, characterized in that it further comprises a separation cylinder and sleeve cyclone-type oil separators, the separation cylinder is disposed above the oil storage cylinder, the perforated plate is installed inside one end of the oil storage cylinder, and several sets of the identical sleeve cyclone-type oil separators are installed inside the separation cylinder. The inner and outer tubes are installed vertically and along the same axis, the inner tube is relatively short and is a central passage, the outer tube and the inner tube form an annular space, the top end of the annular surface is sealed, the air flow enters tangentially from the top of the annular space, rotates and moves downwardly inside the annular space, the centrifugal force makes the oil drops in the air flow to stick to the inner side of the outer wall and flow into the oil storage cylinder by gravity, and when the air flow gets out of the annular space, it moves upwardly along the central tube and converges at the top of the separation cylinder to complete the oil-gas separation.

The US Patent Application US2012099966 disclosed by YoungChan Ma provides a compressor with an internal oil reservoir and a cyclone separator. The rotary compressor disclosed by said patent includes a housing that defines an inlet, a low pressure chamber, an outlet, and a high pressure chamber defining a high pressure lubricant sump. A drive shaft passes through the housing and a compression element is coupled to the drive shaft between the low pressure chamber and the high pressure chamber. A first path connects the high pressure lubricant sump to the low pressure chamber such that lubricant flows through the first path from the high pressure lubricant sump to the low pressure chamber. A low pressure lubricant sump is positioned within the low pressure chamber and includes a movable gate movable from a closed position to an open position in response to a hydrostatic pressure of the lubricant within the low pressure lubricant sump. A second path connects a lubricant separator and the low pressure lubricant sump.

The U.S. Pat. No. 6,554,595 disclosed by HITACHI et al. provides a compressor with an oil-mist separator. In the oil-mist separator included in the compressor disclosed by said patent, a discharge passage directs a flow axis of a mixture gas when the mixture gas reaches a chamber, said mixture gas including a mist of lubrication oil and a gas to be taken out of the compressor with a pressurized condition, and a discharge port for discharging the gas from the chamber opens in the chamber.

The US Patent Application US2004208771 disclosed by HITACHI et al. provides a screw compressor. In the screw compressor disclosed by said patent, an oil separator and an oil reservoir are formed integrally with a main casing. In addition, an opening communicated with the oil reservoir is formed in a part of a lower portion of an oil separation space of the oil separator. Preferably, the opening is formed so that its width is increased as it approaches an outer peripheral side of the oil separation space from a center thereof. Further, a safety valve is installed so that a line connecting the safety valve and the center of the oil separator is made substantially in parallel to axes of screw rotors.

The German Patent Application DE102006017635 assigned by Stefan Becker et al. to Mann & Hummel Gmbh provides an apparatus for separating liquids from gases, said apparatus comprising a pre-separator that separates an untreated gas region from a pre-separator gas region, a main separator comprising a coalescing element for increasing the size of liquid droplets and a post-separator.

The US Patent Application US2010028165 disclosed by HITACHI et al. provides an oil-flooded screw compressor, a motor drive system, and a motor control device. The oil-flooded screw compressor disclosed by said patent comprises: a casing, a pair of rotors each having screw-thread-shaped groove and being housed in the casing, an electric motor for rotationally driving the rotors, a control device for controlling the electric motor, an oil feeding mechanism for feeding oil into working chambers formed by being enclosed by the casing and making the pair of rotors to be meshed to each other by means of teeth thereof, and an oil separating mechanism for separating the oil from the compressed gas discharged from the working chambers, wherein the torque is not increased for a short amount of time after direct start-up and accelerated to a normal operation rotational speed after oil discharge at a low speed drive. Alternatively, after the remaining compressed gas is discharged after a halt, the rotors are rotated for a short amount of time, thereby allowing the oil accumulated inside the working chambers to be discharged and reducing the load of the next start-up.

However, the above-mentioned screw compressors not only have complex structures and numerous parts, but also have relatively low oil separation efficiency, and can only be suitable for dry systems that have relatively low requirements of oil content, while for flooded systems with relatively high requirements of oil content, screw compressors according to the prior art generally have a poor oil separation effect, making it difficult to achieve the optimal process of separation and recycle of the freezing oil inside the screw compressors.

SUMMARY OF THE INVENTION

In light of this, according to a first aspect of the present invention, a screw compressor having an oil separator is provided, which effectively solves the above problems in the prior art and other aspects. In the screw compressor having an oil separator according to the present invention, the screw compressor comprises:

A compressor housing with an inlet for a refrigerant gas flow to flow in;

An oil separator housing connected to the compressor housing in a fastened and sealed manner and having an outlet for the refrigerant gas flow to flow out;

A compressing assembly disposed within the compressor housing and close to the inlet for compressing the refrigerant gas flow;

An electric motor for driving the compressing assembly; and

An oil supply device for supplying a freezing oil to the compressing assembly;

The screw compressor further comprises an oil separator, the oil separator is disposed within the oil separator housing and comprises a first separator for first separation of the freezing oil and a second separator for second separation of the freezing oil, wherein the second separator is disposed close to the outlet, and the first separator is disposed between the compressing assembly and the second separator.

In an embodiment of the screw compressor having an oil separator according to the present invention, an oil tank is provided at the bottom of the compressor housing, and the oil tank is disposed underneath the compressing assembly and the electric motor, and spaced apart from the compressing assembly and the electric motor.

In another embodiment of the screw compressor having an oil separator according to the present invention, the oil tank is configured to extend to be underneath the first separator and the second separator, and is spaced apart from the first separator and the second separator.

In another embodiment of the screw compressor having an oil separator according to the present invention, the second separator is a filtration component made of a metal wire net or woven by glass fibers.

In another embodiment of the screw compressor having an oil separator according to the present invention, the first separator is a centrifugal separator consisted of a trumpet-shaped guide plate and at least a portion of the oil separator housing.

In another embodiment of the screw compressor having an oil separator according to the present invention, the inlet of the compressor housing and the outlet of the oil separator housing are on the same axis.

In another embodiment of the screw compressor having an oil separator according to the present invention, the chamber between the first separator and the second separator is provided with an oil return pipe that leads to the oil tank.

In another embodiment of the screw compressor having an oil separator according to the present invention, the guide plates of the first separator and the second separator are fixed to the inner sidewall of the oil separator housing by means of bolts or welding.

In another embodiment of the screw compressor having an oil separator according to the present invention, a flaring structure is provided at the inlet of the guide plate of the first separator.

In addition, according to a second aspect of the present invention, a water chilling unit is further provided. The water chilling unit is equipped with the above screw compressor having an oil separator, and the water chilling unit is an air-cooled unit or a water-cooled unit or a refrigerating unit.

The technical solution according to the present invention has the following advantageous effects: compared with the prior art, the screw compressor having an oil separator according to the present invention can achieve higher oil separation efficiency. Furthermore, it is favorable for recycling the freezing oil. Furthermore, it makes the structure more compact. Furthermore, it lowers the manufacturing and installation cost. Furthermore, it greatly improves safety and reliability.

BRIEF DESCRIPTION OF THE DRAWINGS

The technical solution according to the present invention will be further described in detail below with reference to the accompanying drawings and embodiments, wherein.

DETAILED DESCRIPTION OF THE PREFERRED EMBODIMENT

First, it should be noted that the position terms used herein, such as top, bottom, front, back, left, right, horizontal and longitudinal, are defined relative to the screw compressor having an oil separator and components thereof shown in the figures, which are relative and may vary according to different positions and different use states thereof. Therefore, these or other position terms may not be interpreted as limiting terms.

Second, it should be further noted that, with respect to any individual technical feature described or implied in the embodiments herein or any individual technical feature illustrated or implied in the figures, combinations may be further made among these technical features (or equivalents thereof), thereby obtaining more other embodiments of the present invention that may not be directly described herein.

Figure 2:
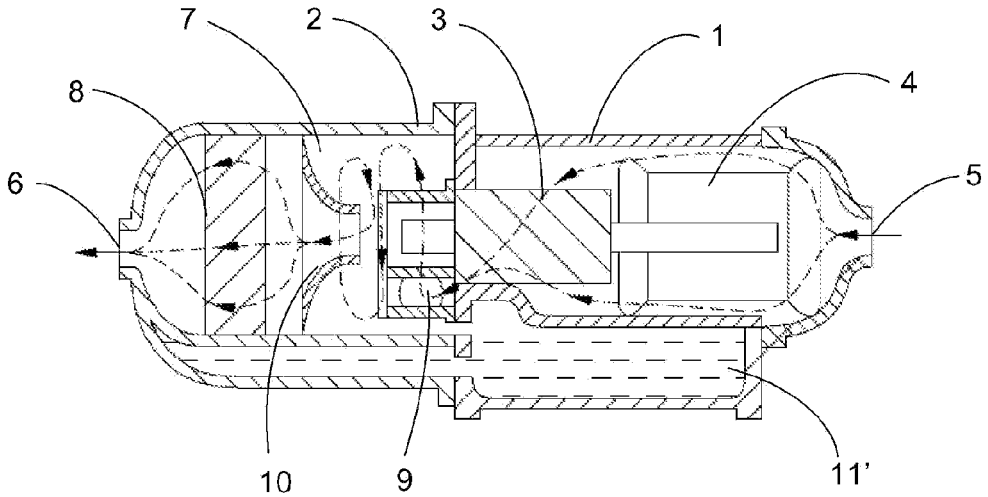
FIG. 2 is a cross-sectional view of another embodiment of the screw compressor having an oil separator according to the present invention.

Please refer to FIG. 2, which illustratively shows the basic structure of an embodiment of the screw compressor having an oil separator according to the present invention. In this embodiment, the screw compressor comprises a compressor housing 1 and an oil separator housing 2, which form the space body of the screw compressor and provide an interior space to accommodate other parts. A compressing assembly 3 for compressing the refrigerating, an electric motor 4 for driving the compressing assembly 3, and an oil supply device (not shown) for supplying a freezing oil to the compressing assembly 3 are provided within the compressor housing 1, while an oil separator is provided within the oil separator housing 2. As shown in the figure, the compressor housing 1 and the oil separator housing 2 are connected in a fastened and sealed manner. In addition, the compressor housing 1 and the oil separator housing 2 may be placed laterally, wherein an inlet 5 for a refrigerant gas flow to flow in is provided at the end of the compressor housing 1, and an outlet 6 for the refrigerant gas flow to flow out is provided at the end of the oil separator housing 2. It should be noted that the compressing assembly 3, the electric motor 4 and the oil supply device are disposed at the side within the compressor housing 1 that is close to the inlet 5, all of which are parts that are well known by those skilled in the art. As a result, they are only depicted illustratively without further description herein. The oil separator comprises a first separator 7 for first separation of the freezing oil and a second separator 8 for second separation of the freezing oil, the second separator 8 is disposed within the oil separator housing 2 that is close to the outlet 6, the first separator 7 is disposed between the compressing assembly 3 and the second separator 8, and similarly may also be disposed within the oil separator housing 2 or close to the connection between the compressor housing 1 and the oil separator housing 2. Structures and principles of the first separator 7 for rough separation and the second separator 8 for refined separation will be described in detail below.

Figure 1:
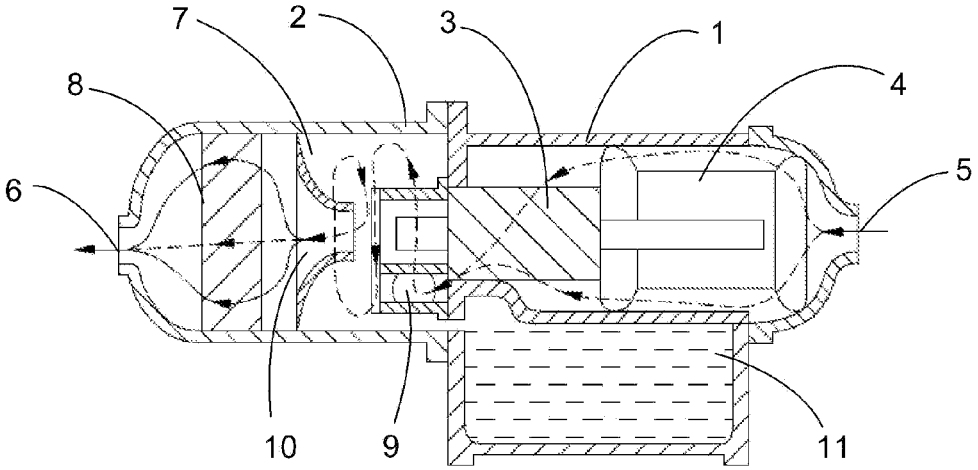
FIG. 1 is a cross-sectional view of an embodiment of the screw compressor having an oil separator according to the present invention.

According to the arrow in FIG. 1 or FIG. 2, the flow sequence of the refrigerant gas flow inside the screw compressor can be clearly seen: the refrigerant gas flow from an evaporator flows in through the inlet 5 of the compressor housing 1 of a screw compressor, and first arrives at the electric motor 4 and the compressing assembly 3, the refrigerant gas flow evenly flows through the electric motor housing and carries away a part of its heat, subsequently enters the screw rotor space inside the compressing assembly 3, where it is further compressed, and at the same time, the oil supply device sprays out a freezing oil, and the freezing oil is mixed with the refrigerant gas flow in the compression process. The refrigerant gas flow carrying the freezing oil after the compression is completed is discharged from the discharge end 9 of the compressing assembly 3 and enters the oil separator. Finally, after the second separation, the refrigerant gas flow flows out of the outlet 6 of the oil separator housing 2 of the screw compressor and enters a condenser in an "oil-free" state. It could be understood that such a flowing pattern from right to left results in a very low flowing loss for the refrigerant gas flow. Preferably, the inlet 5 and the outlet 6 are on the same axis such that the minimal flowing distance of the refrigerant gas flow is as short as possible and the gas flow loss is lower, thereby leading to better performance of the whole screw compressor.

It should be noted that the refrigerant medium according to the present invention may be NH3, Freon, hydrocarbon or others, while the freezing oil may be a synthetic freezing oil, for example, a polyol ester in the Icematic SW series, which is not easy to undergo chemical reactions with the refrigerant, and at the same time, can have excellent effect on cooling, lubricating, sealing and noise reduction.

Please refer to FIG. 1 again, an oil tank 11 is provided at the bottom of the compressor housing 1, and the oil tank 11 is disposed underneath the compressing assembly 3 and the electric motor 4, and spaced apart from them, wherein the chamber between the oil tank 11 and the first separator 7 and the compressing assembly 3 are in fluid communication, such that the freezing oil droplets recycled by the first separator 7 directly return to the oil tank 11 under its own gravity. The specific oil return pattern will be described below. The above oil tank configuration not only makes the circulation of the freezing oil to take place only inside the screw compressor without the need for additional parts, but also can avoid violent fluctuation of the oil surface in case of a relatively high gas flow rate that leads to the freezing oil being carried away by the gas flow.

In addition, to more reasonably make use of the interior space of the screw compressor, in the second embodiment shown in FIG. 2, the oil tank 11' is configured to extend to be underneath the first separator 7 and the second separator 8, and is spaced apart from the first separator 7 and the second separator 8 so as to achieve a more compact structure. In operating conditions such as the compressor stops abruptly or is reversed, the solubility of the refrigerant in the freezing oil decreases significantly due to the sudden drop of pressure, making it easy to precipitate or foam. In such an adverse situation, if the oil tank is disposed at a position relatively far from the inlet and outlet, it is favorable for preventing the foams from being carried away by the gas flow. In this embodiment, only the structural position of the oil tank is reformed. As a result, structural positions of other parts than the oil tank 11', including legends, may refer to the above embodiment, which will not be repeated herein.

It should be further stressed that both the first separator 7 and the second separator 8 of the oil separator are important components of the present invention. It is the cooperation between those two that ultimately the basic function of oil separation is achieved through. The basic construction and working principle of these two parts will be described below.

The first separator 7 is a cyclone separator that is based on the principle of centrifuge, which consists of a guide plate 10 and at least a portion of inner sidewall of the oil separator housing 2, when flowing out of the discharge end 9 of the compressing assembly 3, the mixture of the refrigerant and the freezing oil rotates around the guide plate 10 inside the oil separator housing 2 by means of the gas flow velocity at the discharge end 9, thereby throwing large oil droplets in the gas to the inner wall of the oil separator housing 2 via the centrifugal force, and ultimately, the gas flow will flow to the next separator via the opening of the guide plate 10. As described above, the chamber between the oil tank 11 and the first separator 7 and the compressing assembly 3 are in fluid communication, such that the freezing oil droplets accumulated on the inner wall of the oil separator housing 2 fall downwardly along the inner wall and directly return to the oil tank 11 under its own gravity. As shown in the figure, the guide plate 10 is a trumpet-shaped part, and its opening is gradually expanded in the direction of gas flow. Its principle is similar to that of a Venturi tube that can make the gas flow to evenly flow through the first separator 7 and has the capabilities of stabilizing the flow and reducing the noise. It should be understood that, for the purpose of achieving a better result for the first separation, the guide plate 10 may extend to the inner sidewall of the oil separator housing 2 so as to increase the cyclone area and separate as many large oil droplets in the suspended state as possible. The experiments have proven that the first separator 7 can effectively separate the freezing oil droplets with the diameter above 5 microns, and the first separation can achieve an effect of more than 90% of oil droplets being separated.

It can be learned that the second separator 8 is a filter-type oil separator, which is a tight filtering component with certain thickness and may be made by tightly weaving a net woven by fine metal wires or made of glass fibers. It is this unique structural advantage that enables it to filter or separate oil droplets with the diameter less than 5 microns. On the other hand, since the gas flow has the consistent flowing direction before and after passing the filter net, the gas flow becomes more even and stable during flowing. It should be understood that, to effectively make use of the filtration area of the entire filter, the body part of the second separator 8 (i.e. the filter) may extend to the inner sidewall of the oil separator housing 2 so as to increase the filtration and circulation areas and make small oil droplets in the suspended state to be separated, thereby achieving a better result for the second oil separation. Apparently, to small oil droplets, the oil separation efficiency of a filter-type oil separator is far higher than that of a cyclone separator. However, it should be noted that the first separator 7 separates or filters most of the oil droplets first such that oil droplets subsequently passing through the second separator 8 are less, thereby greatly improving the oil separation efficiency of the second separator 8. In other words, the two-step separation of the oil separator (i.e. the pattern that combines a cyclone separator and a filter-type separator) can lead to a significantly improved oil separation efficiency inside a screw compressor.

Those skilled in the art should be aware that the compressor housing 1 and the oil separator housing 2 of the screw compressor according to the present invention may be made by means of casting, and in such a circumstance, the guide plates 10 of the first separator 7 and the second separator 8 may be fixed to the inner sidewall of the oil separator housing 2 by means of a baffle (not shown) with bolts. In addition, if the oil separator housing 2 of the screw compressor is made of a steel tube, the guide plates 10 of the first separator 7 and the second separator 8 may be fixed to its inner sidewall by means of welding. Considering that the centrifugal force makes oil droplets in the gas flow to stick to the inner sidewall of the oil separator housing 2, which flow downwardly under the action of gravity, certain amount of the freezing oil may accumulate in the chamber between the first separator 7 and the second separator 8. Therefore, an oil return pipe leading to the oil tank 11 may be provided at the baffle position so as to recycle the freezing oil to the highest degree possible.

In a preferred situation, a flaring structure may be provided at the inlet of the guide plate 10 of the first separator 7, i.e. a small trumpet mouth is provided at the inlet of the guide plate 10. It should be understood that the mixed gas of the refrigerant and the freezing oil is thrown externally to the guide plate 10 by the centrifugal force, at least a part of the oil droplets will accumulate at the inlet of the guide plate 10. After a period, they may possibly flow to the edge of the inlet without being carried away by the gas flow. Therefore, the above flaring structure can prevent the separated oil droplets from being carried away again, and can very well guide these remaining oil droplets to converge and fall downwardly to return to the oil tank 11.

As described above, the screw compressor having an oil separator according to the present invention has numerous advantages in the overall construction, detailed structure, etc., which not only can effectively make use of the interior space of the screw compressor and improve the oil separation efficiency inside the screw compressor, but also can be favorable for recovering and recycling the freezing oil. As a result, the provision of said screw compressor is suitable for a flooded water chilling unit that has very high requirements for effects of oil separators, in particular an air-cooled unit or a water-cooled unit or a refrigerating unit for freezing, medium temperature and low temperature.

A number of specific embodiments are listed above to describe in detail the screw compressor having an oil separator according to the present invention and the water chilling unit equipped with the screw compressor. These examples are only provided to describe the principles and embodiments of the present invention, and they may not be construed to be any limitation to the present invention. In addition, with respect to any individual technical feature described or implied in the embodiments herein or any individual technical feature illustrated or implied in the figures, arbitrary combinations or deletions may still be made among these technical features (or equivalents thereof), thereby obtaining more other embodiments of the present invention that may not be directly described herein. Therefore, all equivalent technical solutions shall be encompassed by the present invention and defined by the claims of the present invention.

The invention claimed is:

1. A screw compressor having an oil separator, said screw compressor comprising:

a compressor housing with an inlet for a refrigerant gas flow to flow in;

an oil separator housing connected to the compressor housing in a fastened and sealed manner and having an outlet for the refrigerant gas flow to flow out;

a compressing assembly disposed within the compressor housing and close to the inlet for compressing the refrigerant gas flow;

an electric motor for driving the compressing assembly;

wherein the screw compressor further comprises an oil separator, the oil separator is disposed within the oil separator housing and comprises a first separator for first separation of a freezing oil and a second separator for second separation of the freezing oil, wherein the second separator is disposed close to the outlet, and the first separator is disposed between the compressing assembly and the second separator;

wherein the first separator comprises a cyclone separator configured to rotate a mixture of refrigerant and oil around a guide plate inside the oil separator housing;

wherein the second separator comprises a filter-type oil separator.

2. The screw compressor according to claim 1, wherein an oil tank is provided at the bottom of the compressor housing, and the oil tank is disposed underneath the compressing assembly and the electric motor, and spaced apart from the compressing assembly and the electric motor.

3. The screw compressor according to claim 2, wherein the oil tank is configured to extend to be underneath the first separator and the second separator, and is spaced apart from the first separator and the second separator.

4. The screw compressor according to claim 1, wherein the second separator includes a filtration component made of a metal wire net or woven by glass fibers.

5. The screw compressor according to claim 1, wherein the guide plate is trumpet-shaped.

6. The screw compressor according to claim 1, wherein the inlet of the compressor housing and the outlet of the oil separator housing are on the same axis.

7. The screw compressor according to claim 2, wherein a chamber between the first separator and the second separator leads to the oil tank.

8. The screw compressor according to claim 5, wherein the guide plates of the first separator and the second separator are fixed to an inner sidewall of the oil separator housing by means of bolts or welding.

9. The screw compressor according to claim 5, wherein a flaring structure is provided at an inlet of the guide plate of the first separator.

10. A screw compressor having an oil separator, said screw compressor comprising:

a compressor housing with an inlet for a refrigerant gas flow to flow in;

an oil separator housing connected to the compressor housing in a fastened and sealed manner and having an outlet for the refrigerant gas flow to flow out;

a compressing assembly disposed within the compressor housing and close to the inlet for compressing the refrigerant gas flow;

an electric motor for driving the compressing assembly;

wherein the screw compressor further comprises an oil separator, the oil separator is disposed within the oil separator housing and comprises a first separator for first separation of a freezing oil and a second separator for second separation of the freezing oil, wherein the second separator is disposed close to the outlet, and the first separator is disposed between the compressing assembly and the second separator;

wherein the inlet of the compressor housing and the outlet of the oil separator housing are on the same axis;

wherein the first separator is a cyclone separator configured to rotate a mixture of refrigerant and oil around a guide plate inside the oil separator housing by gas flow velocity at a discharge end of the compressing assembly;

wherein the second separator comprises a filter-type oil separator.

* * * * *